United States Patent [19]

Anderson, III et al.

[11] Patent Number: 4,476,762

[45] Date of Patent: Oct. 16, 1984

[54] CUTTING DIE SUPPORTING PLATE APPARATUS

[76] Inventors: Frank T. Anderson, III, 8526 International Ave., Canoga Park, Calif. 91304; Darold Kaiser, 21711 Birch Hill Dr., Diamond Bar, Calif. 91765

[21] Appl. No.: 340,233

[22] Filed: Jan. 18, 1982

[51] Int. Cl.[3] ..... B26F 1/40

[52] U.S. Cl. ..... 83/640; 83/699; 279/1 M

[58] Field of Search ..... 83/561, 562, 640, 641, 83/698, 699, 700; 279/1 M

[56] References Cited

U.S. PATENT DOCUMENTS

| | | | |
|---|---|---|---|
| Re. 12,234 | 6/1904 | Parsons | 83/562 |
| 781,297 | 1/1905 | Parsons | 83/699 X |
| 2,912,249 | 11/1959 | Eckold | 279/1 M |
| 3,370,492 | 2/1968 | Treff | 83/561 X |
| 3,779,118 | 12/1973 | Habenec | 83/699 X |
| 3,797,351 | 3/1974 | Jones, Jr. | 83/698 |
| 3,826,170 | 7/1974 | Jones et al. | 83/698 X |
| 4,210,047 | 7/1980 | Haas et al. | 83/699 X |

*Primary Examiner*—James M. Meister

*Attorney, Agent, or Firm*—Jack C. Munro

[57] ABSTRACT

A plate for the mounting and supporting of a cutting die to be utilized within a machine for the cutting of envelopes from a stack of sheet paper. The metallic cutting die is held by magnets which are embedded with the plate. Mounted within the plate are a plurality of slidable members which are to engage with the cutting die to fixedly lock the cutting die in the established position upon the plate. Also included within the plate is a breaker bar assembly which can be moved to separate the cutting die from the holding force of the magnets when it is desired to change the cutting die.

5 Claims, 8 Drawing Figures

CUTTING DIE SUPPORTING PLATE APPARATUS

BACKGROUND OF THE INVENTION

The field of this invention relates to a machine for cutting envelopes, or other similar types of products, from a stack of sheet paper, and more particularly for a novel arrangement for the cutting die to facilitate quick and easy attachment and removal of the cutting die from the machine.

It is well known to employ the use of a wide variety of different sizes of envelopes which are larger than the conventional letter size envelope. These envelopes are constructed from sheet paper. In the manufacture of these envelopes, a stack of sheet paper is placed upon a winding station of an envelope cutting machine. This machine includes a working station which is movable in respect to the working platform. The working station is normally movable by means of hydraulic actuators toward and away from the working platform. The working station includes a cutting die which is to be highly sharpened so as to penetrate the stack of sheets of paper. The shape of the cutting die is precisely the shape of the particular envelope prior to the folding and enclosing of the envelope.

The conventional procedure for mounting the cutting die is as follows: Each die is normally drilled and tapped with a series of holes, generally about four to six per cutting die. These holes are to match with holes on the die supporting plate. It takes two individuals to correctly position the die on the die supporting plate. Once the die is properly positioned, the fasteners are then tightened to secure the position of the cutting die.

At this time, it is normally required to locate an ejector pad within the enclosed area of the cutting die. The purpose of the ejector pad is to prevent the cut paper blanks from sticking within the enclosed area of the cutting die. This ejector pad is to be bolted to the die supporting plate. It is to be kept in mind that the outermost edge of the cutting die is extremely sharp. In fact, it would take very little contact with the die for an individual to become severly injured. Therefore, the placing of this ejector pad on the die supporting plate is an extremely dangerous operation.

Normally, this entire operation of mounting the cutting die requires at least forty-five to sixty minutes. In any given day, upon a single envelope cutting machine, the cutting die can be replaced two to three times. This means that out of an eight hour working day, two to three hours in time is necessary to merely change the cutting dies. This is time that the machine is not working to produce envelopes.

SUMMARY OF THE INVENTION

The structure of this invention relates to an improved arrangement for the supporting of a cutting die within an envelope cutting machine. The time required to replace a cutting die utilizing the mounting structure of this invention requires only four minutes. It is never necessary to remove and replace the ejector pad. Therefore, the operator is never required to place his hands and arms under the sharp edge of the cutting die.

The conventional envelope cutting machine essentially comprises a press wherein there is a cutting die connected to a supporting station. This supporting station is movable toward and away from a working platform. The cutting die is supported on the supporting station by a die support plate. The improvement having to do with this invention relates to the construction of the die support plate wherein the die support plate has imbedded therein a plurality of magnets. The magnets function to hold the cutting die in position against the die supporting plate. Also attached to the die supporting plate is a locking assembly which is to be connectable to the cutting die to lock such in an exact position on the die supporting plate. Also connected to the die supporting plate is a breaker bar assembly which is to break the magnetic force holding the die supporting plate when it is desired to remove the cutting die.

DETAILED DESCRIPTION OF THE SHOWN EMBODIMENT

Figure 1:
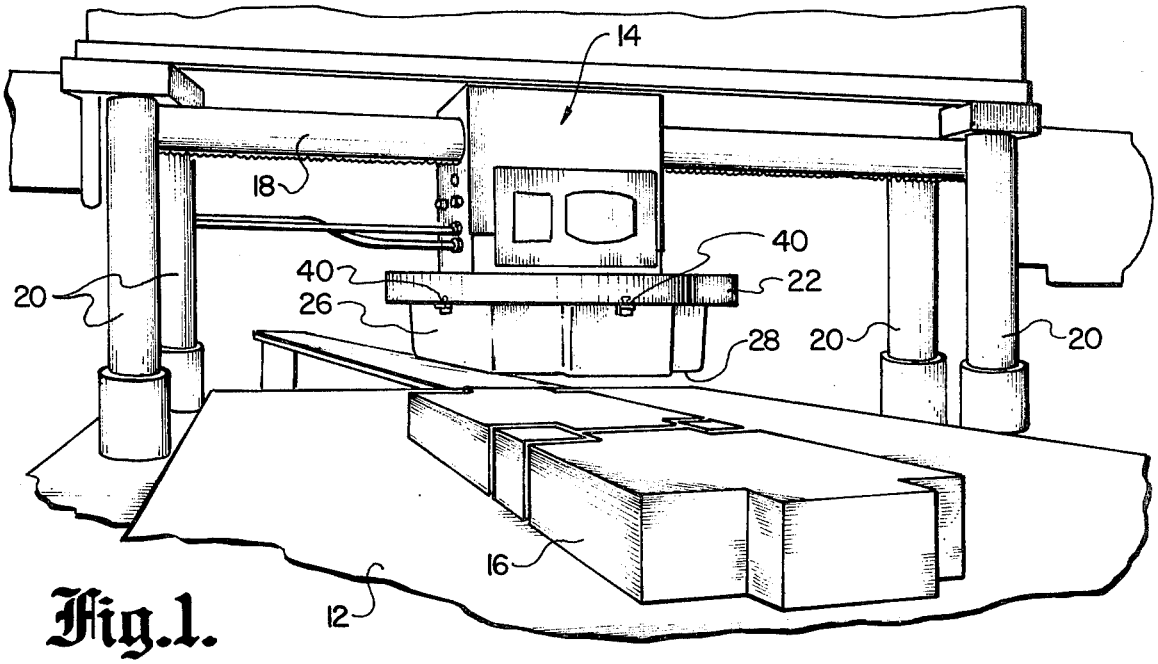
FIG. 1 is an isometric view of an envelope cutting machine within which has been incorporated the cutting die supporting plate of this invention.
Figure 2:
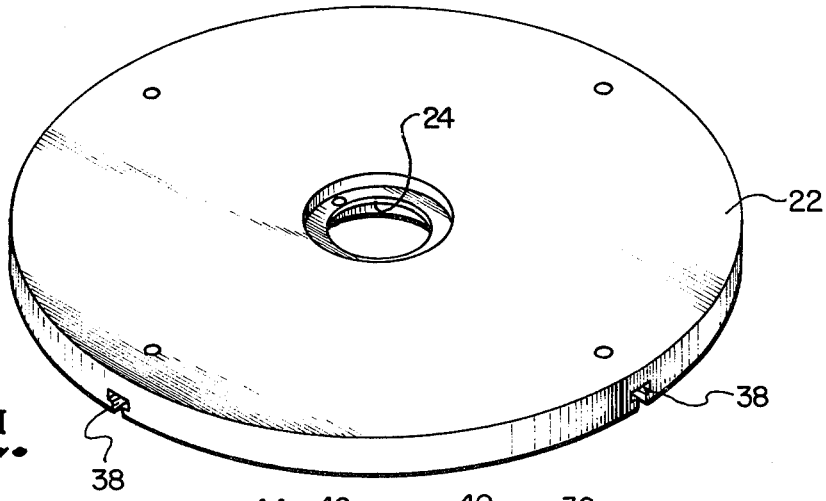
FIG. 2 is a top isometric view of the die supporting plate of this invention.
Figure 3:
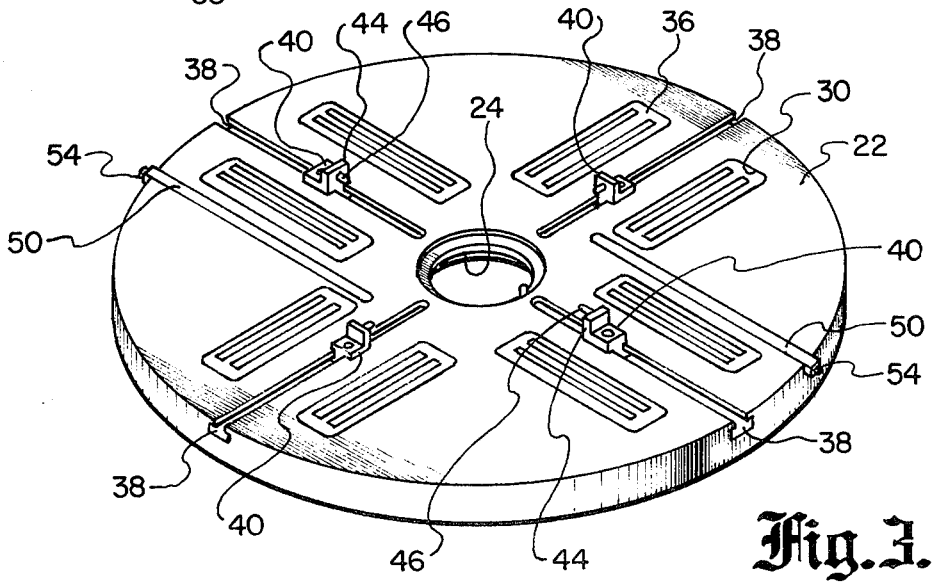
FIG. 3 is a bottom isometric view of the die supporting plate of this invention.

Referring particularly to the drawings, there is shown in FIG. 1 an envelope cutting machine 10 which is composed generally of a working platform 12 and a die supporting station 14. The working platform 12 comprises a planar surface. Across the working platform 12 there is to be moved a stack 16 of sheets of paper.

The die supporting station 14 is mounted on a cross member 18. The ends of the cross member 18 are supported by upright members 20 which are fixedly attached to and extend from the working platform 12. The die support station 14 also includes a die support plate 22. This die support plate 22 is movable toward and away from the working platform 12 by means of an actuating mechanism (not shown) included within the die support station 14. The die support plate 22 is to be fixedly mounted to the die support station 14 by means of bolt fasteners (not shown).

Also centrally formed within the die support plate 22 is an opening 24. Through this opening 24, there is to extend an ejector pad (not shown). The purpose of the ejector pad is to prevent the cut paper blanks from the stack 16 from sticking within the cutting die 26.

The cutting die 26 is constructed of a integral piece of metallic material which defines an enclosed area of a specific shape. A piece of paper sheet material, when cut into this particular shape can then be folded to obtain an envelope of a particular size. It is to be understood that there will be available numerous cutting dies 26 which define different sizes of confining areas. Each cutting die 26 will be capable of cutting a blank for a specific sized envelope.

The cutting die 26 has a sharpened outer edge 28. This edge is to be honed to a high degree of sharpness so that it will be capable of cutting through, in a clean manner, several hundred sheets of paper within the stack 16. Also, the sharpness is such that this cutting action can be repeated a significant number of times without requiring resharpening.

The die supporting plate 22 will normally be constructed of a metallic material, such as aluminum. The bottom surface of the plate 22 includes a plurality of hollowed out recesses 30. Each recess is shown to be basically rectangular in shape. It is to be noted that there are actually eight in number of recesses 30. However, it is deemed to be within the scope of this invention that this number could be either increased or decreased.

Within each recess 30 are to be located a plurality of bar magnets 32. The magnets 32 are what are frequently termed "permanent" magnets. The bar magnets are separated by spacers 34. Normally, the spacers 34 do not comprise magnetizable material. It is important that during use of the die supporting plate 22 that the bar magnets 32 are never contacted by the cutting die 26. Therefore, the magnets 32 never become nicked or gouged. Any time a magnet is nicked or gouged, its effectiveness is immediately somewhat diminished. Therefore, the height of each of the magnets 32 is less than the height of each recess 30. A quantity of epoxy resin 36 is to be poured into this space provided above the magnets 32 and the spacers 34 until the epoxy resin 36 becomes flush with the bottom surface of the die support plate 22. This epoxy resin is then permitted to harden. It is to be noted that with this particular type of construction, there should never be a need to replace the magnets 32, as they should last decades.

Formed within the bottom surface of the die support plate 22 are four in number of T-shaped grooves 38. The grooves 38 are radially disposed with respect to the center of the die support plate 22. Also, the grooves 38 are equiangularly spaced apart. Therefore, there is a ninety degree spacing arrangement between adjacent grooves 38.

Slidably mounted within each groove 38 is a T-shaped locking member 40. Each T-shaped locking member 40 is constructed of two separate members which are held together by a bolt fastener 42. By tightening of the bolt fastener 42, the looseness or snugness of the connecting of the T-shaped member 40 within the groove 38 is thereby varied.

Each T-shaped locking member 40 includes an upstanding extension 44. Extending outwardly from the extension 44 is a pin 46. Each pin 46 is to connect with a separate opening 48 formed within a sidewall of the cutting die 26. It is to be understood that there will be four in number of the openings 48. It is further understood that each opening 48 will be centrally disposed with respect to its respective side of the cutting die 26. Therefore, with the cutting die 26 being magnetically held upon the bottom surface of the die support plate 22 and moving each of the locking members 40 so that a pin 46 connects with an opening 48, then it is to be known that the cutting die 26 has to be centrally positioned upon the bottom surface 22 of the die supporting plate 22. Upon the pins 46 being located in the openings 48, the bolts 42 are then tightened, thereby securing the T-shaped locking members in position upon the die supporting plate 22.

Figure 4:
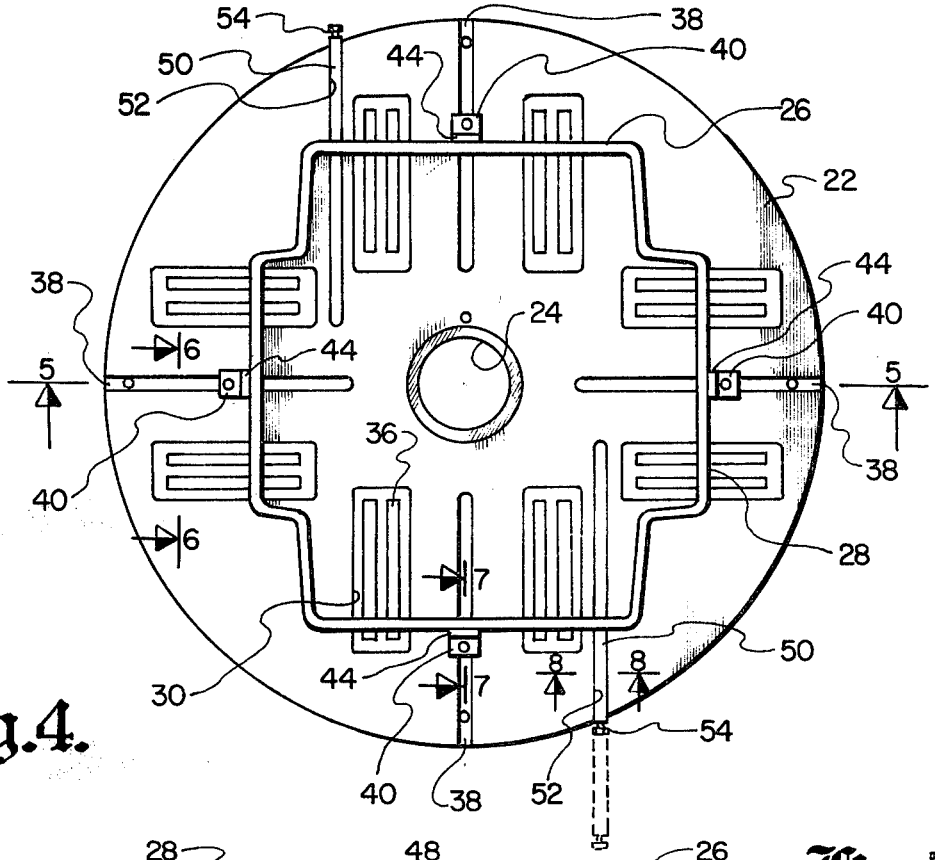
FIG. 4 is a plan view of the bottom surface of the die supporting plate of this invention showing a cutting die being mounted thereon.
Figure 5:
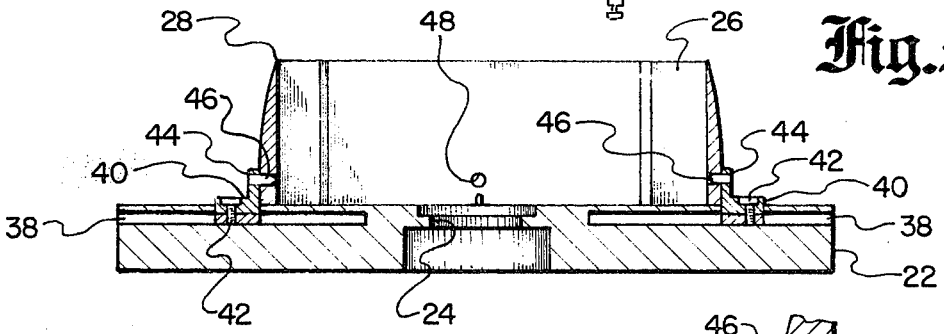
FIG. 5 is a cross-sectional view taken along 5—5 of FIG. 4.
Figure 6:
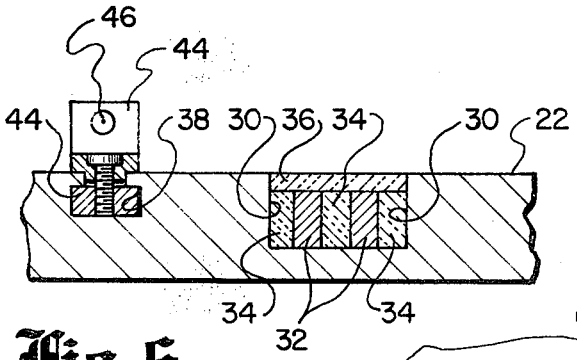
FIG. 6 is a cross-sectional view taken along line 6—6 of FIG. 4.
Figure 7:
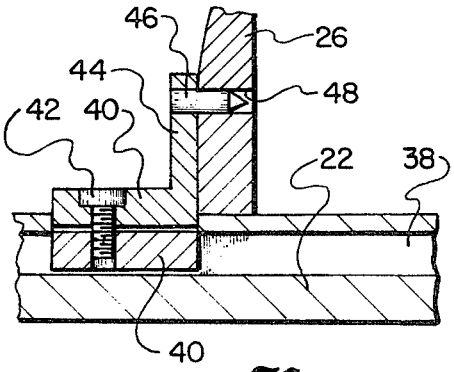
FIG. 7 is a cross-sectional view taken along line 7—7 of FIG. 7.
Figure 8:
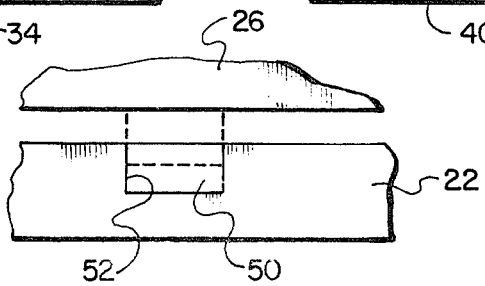
FIG. 8 is a cross-sectional view taken along line 8—8 of FIG. 4.

As previously mentioned, at times it is going to be necessary to replace the cutting die 26. The magnetic holding force of the magnets 32 is so strong that removing of the cutting die 26 cannot be easily accomplished even when the cutting die 26 is hanging from the bottom surface of the die supporting plate 22. Therefore, to assist in the disconnecting of the cutting die 26 from the die support plate 22, a breaker bar assembly is employed. This breaker bar assembly comprises two separate breaker bars 50. Each of the breaker bars 50 are located within an appropriate slot 52 (two in number) formed within the bottom surface of the die supporting plate 22. The length of each breaker bar is such that it extends from the periphery of the die supporting plate 22 to the position located almost adjacent the center of the die supporting plate 22. Each breaker bar 50 includes a graspable enlarged outer end 54. With each breaker bar 50 in the solid position shown within FIG. 4, each breaker bar 50 is held in that position by being located within a recess (not shown) at its innermost end. Therefore, each breaker bar 50 will be prevented from falling free even if the cutting die 26 was not located upon the bottom surface of the die supporting plate 22.

When it is desired to remove the cutting die from the die supporting plate 22, the user must first disengage each of the locking members 40 by loosening of the bolt fasteners 42 and physically moving the members 40 so that the pins 46 disengage from their respective openings 48. The operator then grasps the handle 54 of one of the breaker bars 50 and withdraws such from its inwardly receiving recess (not shown). The operator can then use that respective breaker bar 50 as a lever pushing against the cutting die 26 to force such away from the surface of the die supporting plate 22 until the cutting die 26 is broken from the die supporting plate 22. Once the cutting die is so removed, the breaker bar 50 is then replaced to within the solid line position shown in FIG. 4.

It is to be understood that when the cutting die 26 is removed or when a new cutting die 26 is to be installed, there will be utilized some type of a movable platform which will be positioned directly beneath the die supporting plate 22. The platform may either physically move the die 26 into engagement with the die supporting plate 22 or the die supporting plate 22 may be moved down into engagement with the cutting die 26.

What is claimed is:

1. In combination with an envelope cutting machine having a working platform upon which is to be located a stack of sheet paper, a die support station, said die support station being movable toward and away from said working platform, a die support plate connected to said die support station, a cutting die mounted on said die support plate, the improvement comprising:

magnet holding means included within said die support plate, said means included within said die support plate, said magnet holding means for connecting with and supporting said cutting die; and separation means mounted within said die supporting plate, said separation means being movable to permit separating of said cutting die from said die supporting plate in order to change said cutting die.

2. The combination as defined in claim 1 wherein:

said separation means taking the form of a breaker bar, said breaker bar being slidably mounted within said die supporting plate.

3. In combination with an envelope cutting machine having a working platform upon which is to be located a stack of sheet paper, a die support station, said die support station being movable toward and away from said working platform, a die support plate connected to said die support station, a cutting die mounted on said die support plate, the improvement comprising:

magnet holding means included within said die support plate, said magnet holding means for connecting with and supporting said cutting die;

locking means mounted on said die support plate, said locking means including connection means, said connection means to engage with said cutting die to fix the position of said cutting die;

said locking means comprising a plurality of members which are slidably mounted on said die supporting plate, an opening assembly formed within said cutting die, said plurality of members to engage with said opening assembly thereby fixing the position of said cutting die upon said die supporting plate; and separation means mounted within said die supporting plate, said separation means being movable to permit separating of said cutting die from said die supporting plate in order to change said cutting die.

4. The combination as defined in claim 3 wherein:

said separation means taking the form of a breaker bar, said breaker bar being slidably mounted within said die supporting plate.

5. The combination as defined in claim 4 wherein:

said magnet holding means comprising a plurality of separate magnets imbedded within said die supporting plate.

* * * * *